US009581412B2

(12) United States Patent
Cheng et al.

(10) Patent No.: US 9,581,412 B2
(45) Date of Patent: Feb. 28, 2017

(54) KEYMOD MOUNT

(71) Applicants: Carson Cheng, City of Industry, CA (US); Jason Michael Cheng, City of Industry, CA (US)

(72) Inventors: Carson Cheng, City of Industry, CA (US); Jason Michael Cheng, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 410 days.

(21) Appl. No.: 14/252,770

(22) Filed: Apr. 14, 2014

(65) Prior Publication Data

US 2016/0216061 A1 Jul. 28, 2016

(51) Int. Cl.
*F41A 15/00* (2006.01)
*F41C 27/00* (2006.01)
*F41G 11/00* (2006.01)

(52) U.S. Cl.
CPC ..... *F41C 27/00* (2013.01); *F41G 11/005* (2013.01)

(58) Field of Classification Search
CPC ..... F41C 27/00
See application file for complete search history.

(56) References Cited

U.S. PATENT DOCUMENTS 8,752,320 B2 * 6/2014 Masters ..... F41C 23/16 42/71.01
8,925,236 B1 * 1/2015 Mayberry ..... F41G 11/005 42/124
D746,404 S * 12/2015 Chow ..... D22/108
9,239,210 B2 * 1/2016 Mayberry ..... F41C 23/16
9,341,441 B2 * 5/2016 Cheng ..... F41C 27/00
9,377,274 B2 * 6/2016 Kincel ..... F41C 23/16
2009/0100734 A1 * 4/2009 Swan ..... F41G 11/003 42/71.01
2012/0167434 A1 * 7/2012 Masters ..... F41C 23/16 42/90
2014/0041273 A1 * 2/2014 Masters ..... F41C 23/16 42/71.01
2015/0219422 A1 * 8/2015 Kincel ..... F41C 23/16 29/525.11
2015/0241169 A1 * 8/2015 Cheng ..... F41G 1/00 42/114
2015/0267993 A1 * 9/2015 Cheng ..... F41C 27/00 42/90

(Continued)

*Primary Examiner* — Samir Abdosh
(74) *Attorney, Agent, or Firm* — Raymond Y. Chan; David and Raymond Patent Firm

(57) ABSTRACT

A keymod mount, which is arranged for detachably coupling at a firearm having one or more keymod slots, includes a securing member and a locking member movably extended from the securing member. The securing member includes a mounting body having a top utility surface, and a coupling head downwardly extended from a bottom surface of the mounting body for slidably engaging with a narrow slot portion of the keymod slot to retain said mounting body on a top surface of the keymod slot. The locking member includes a locking body and a locking head downwardly extended from a bottom surface of the locking body for inserting into an enlarged slot portion of the keymod slot after the coupling head is engaged with the narrow slot portion thereof, so as to securely lock up the securing member on the firearm.

19 Claims, 18 Drawing Sheets

(56) References Cited

U.S. PATENT DOCUMENTS

| | | | | |
|---|---|---|---|---|
| 2015/0285583 | A1* | 10/2015 | Mayberry | F41G 11/005<br>42/71.01 |
| 2015/0285584 | A1* | 10/2015 | Mayberry | F41C 23/16<br>42/71.01 |
| 2015/0316354 | A1* | 11/2015 | Cheng | F41G 11/001<br>42/90 |
| 2016/0116246 | A1* | 4/2016 | Daniel | F41A 35/02<br>42/90 |
| 2016/0187100 | A1* | 6/2016 | Mayberry | F41C 27/00<br>42/90 |

* cited by examiner

KEYMOD MOUNT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a firearm accessory attachment system of a firearm, and more particular to a KeyMod mount, which provides a quick and precise attachment to be detachably mounted at the firearm.

Description of Related Arts

Conventional rail systems, such as "Picatinny rail system, have evolved in the firearm industry from a military standard. The conventional rail system generally provides a rail comprising a plurality of T-shaped cross sectional raised ridges formed at the firearm, and an adapter provided at the accessory, wherein the accessory can be mounted at the rail by transversely sliding the adapter at the rail and fastening the adapter at the rail via a bolt. However, the conventional rail system has several drawbacks. The rail will only enable the accessory to be mounted at the firearm at the transverse direction. It is not ergonomic for a user to hold the firearm and mount the accessory to the rail in a transverse direction to the discharge axis of the firearm. In addition, the rail profile with the raised ridges will substantially increase the overall weight of the firearm. More importantly, the rail cannot provide a quick and precise attachment for the firearm because the adapter must be fastened with the rail by the bolt.

A "KeyMod" rail system is an improved system superior to the conventional rail system. The KeyMod mounting arrangement generally comprises a plurality of KeyMod mounting slots provided at the firearm and a KeyMod mounting nut provided at the accessory. In particular, each of the mounting slots, which is extended along the discharge axis of the firearm, has a keyhole configuration defining an enlarged slot portion with larger diameter and a narrower slot portion extended therefrom, wherein the slot is chamfered on the backside. Therefore, the mounting nut can be disposed in the enlarged slot portion and slid to the narrower slot portion. Then, the mounting nut can be fastened at the narrower slot portion by a bolt to lift the mounting nut at the backside of the mounting slot in order to secure the accessory at the firearm. The KeyMod rail system can solve the existing problems by providing an ergonomic mounting way to mount the accessory at the firearm corresponding to the discharge axis thereof, and by substantially reducing the overall weight of the firearm incorporating with the KeyMod mounting slots. However, the KeyMod rail system has several drawbacks.

The alignment between the mounting nut and the enlarged slot portion of the mounting slot must be precise. Especially when two or more mounting nuts are provided at the accessory, the user must correctly align the mounting nuts with the enlarged slot portions of the mounting slots respectively. Since the mounting nuts are movable, the user must hold the mounting nuts stationary before the mounting nuts are plugged into the enlarged slot portions of the mounting slots. It is worth mentioning that the mounting nuts can only be stationary or locked after the mounting nuts are lifted by the bolts to couple at the narrower slot portions of the mounting slots. In other words, the KeyMod rail system provides a displeasing mounting operation comparing with the conventional "Picatinny rail system or "Weaver" rail system. Furthermore, the KeyMod rail system still cannot provide a quick and precise attachment for the firearm because the mounting nut must be fastened with the mounting slot by the bolt.

The two different rail systems are commonly found in a handguard to give more room for attaching the accessory to the firearm. Accordingly, the handguard is mounted at a front portion of a firearm to serve not only as a guard to protect the barrel but also as a hand grip for the user to grip the firearm. The handguard has a polygonal cross section and defines a plurality of longitudinal faces, wherein conventional rail system is formed on the top longitudinal face of the handguard while the KeyMod mounting slots are formed at the rest of the longitudinal faces. The KeyMod mounting slots serve as heat dissipating holes formed in series on each longitudinal face of the handguard to dissipate heat from the barrel since it may become very hot when firing. Therefore, the accessory can be mounted to the handguard by either the conventional rail system or the KeyMod rail system. However, the existing handguard has several drawbacks.

Since the handguard is made of metal for heat dissipation, the edges of the KeyMod mounting slots will be sharp enough to cut the skin of the user especially by the recoil force of the firearm when the user grips the handguard. More importantly, the handguard will burn the hand of the user when it becomes extremely hot. Therefore, a handguard cover is found in the market to solve the above mentioned problems. The handguard cover, which is made of soft material such as rubber, comprises a cover panel and an elastic plug pressed into one of the KeyMod mounting slots in order to cover the cover panel on the exterior side of the longitudinal face of the handguard. This handguard can substantially provide a comfortable touch and can block the heat from the barrel to burn the hand of the user when the user grips the handguard. However, the handguard cover is held at the handguard by the elastic force of the elastic plug at the KeyMod mounting slot, such that the handguard cover can be easily detached from the handguard. In addition, the handguard cover can only cover two or more KeyMod mounting slots at the same longitudinal face of the handguard. In other words, if the user wants to cover two KeyMod mounting slots at different longitudinal faces of the handguard, two handguard covers are required. More importantly, when the KeyMod mounting slot is covered by the handguard cover, the accessory cannot be mounted at the same KeyMod mounting slot.

SUMMARY OF THE PRESENT INVENTION

The invention is advantageous in that it provides a Keymod mount, which provides a quick and precise attachment for the Keymod rail system.

Another advantage of the invention is to Keymod mount, which can incorporate an existing Keymod slot rail to mount the accessory, such as handguard cover, laser module, scope mount, flashlight module, navigation light module, camera module, vertical grip, rail panel, hand stop, barricade support, at the firearm.

Another advantage of the invention is to Keymod mount, which is slid and pressed to securely engage with the Keymod slot, so as to precisely and rapidly attach the Keymod mount to the firearm so as to enhance the mounting operation of the accessory at the firearm.

Another advantage of the invention is to Keymod mount, which comprises a coupling head slidably engaged with a narrower slot portion of the Keymod slot and a locking head inserted into an enlarged slot portion of the Keymod slot to secure the attachment between the keymod mount and the firearm.

Another advantage of the invention is to Keymod mount, which provides an extremely low profile configuration to minimize a distance between the top side of the Keymod slot and the attachment surface of the firearm.

Another advantage of the invention is to Keymod mount, which can be selectively modified to engage with one Keymod slot, a series of Keymod slots at the same longitudinal face, or two or more Keymod slots at different longitudinal faces of the handguard, so as to broaden the practical use of the Keymod mount.

Another advantage of the invention is to Keymod mount, which can serve as a handguard cover for the handguard and can be configured corresponding to a hand size of the user. Therefore, only the hand sized area of the handguard is covered by the handguard while the rest area of the handguard will be uncovered for heat dissipation.

Another advantage of the invention is to a Keymod mount, wherein the user does not require any tool to fasten and secure at the Keymod slot, such that the Keymod mount provides a tool-less mounting system to speed up the mounting operation at the firearm.

Another advantage of the invention is to a Keymod mount, which does not ft) require to alter the original structural design of the Keymod mounting structure of the firearm, so as to minimize the manufacturing cost of the Keymod mounting structure of the firearm incorporating with the Keymod mount of the present invention.

Another advantage of the invention is to a Keymod mount, which comprises at least one positioning member arranged to engage with a second Keymod slot, so as to ensure the corrected alignment between the Keymod mount and the firearm and to prevent any unwanted longitudinal and/or rotational movement of the Keymod mount with respect to the firearm after the Keymod mount is mounted to the firearm.

Another advantage of the invention is to provide a Keymod mount, wherein no expensive or complicated structure is required to employ in the present invention in order to achieve the above mentioned objects. Therefore, the present invention successfully provides an economic and efficient solution for providing a secure and reliable configuration for detachably mounting any accessory at the firearm with compact and ergonomic design.

Additional advantages and features of the invention will become apparent from the description which follows, and may be realized by means of the instrumentalities and combinations particular point out in the appended claims.

According to the present invention, the foregoing and other objects and advantages are attained by a keymod mount for detachably coupling at a firearm having one or more keymod slots, wherein the keymod mount comprises a securing member and a locking member movably extended from the securing member.

The securing member comprises a mounting body having a top utility surface, and a coupling head downwardly extended from a bottom surface of the mounting body for slidably engaging with a narrow slot portion of the keymod slot to retain the mounting body on a top surface of the keymod slot.

The locking member comprises a locking body and a locking head downwardly extended from a bottom surface of the locking body for inserting into an enlarged slot portion of the keymod slot after the coupling head is engaged with the narrow slot portion thereof, so as to securely lock up the securing member on the firearm.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
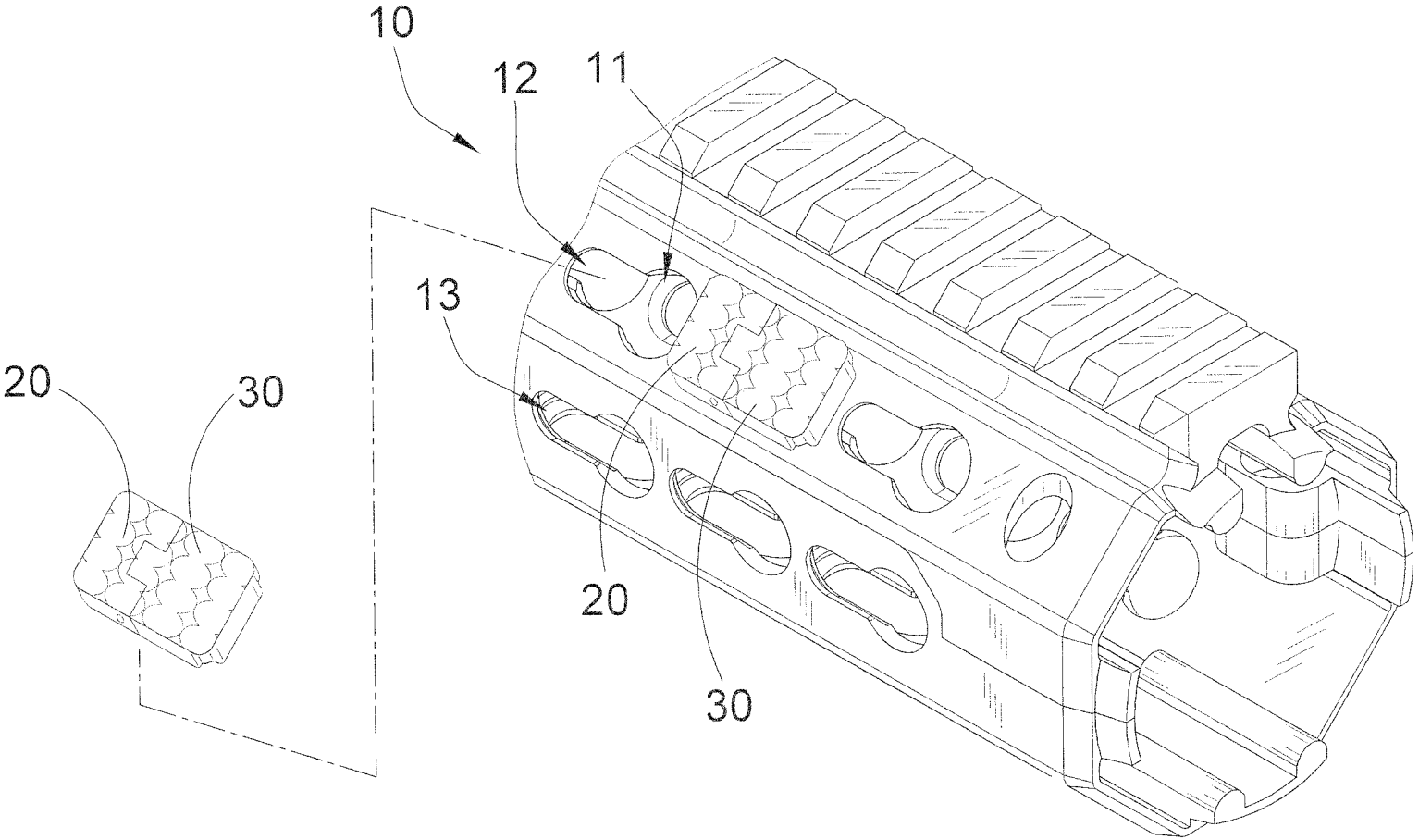
FIG. 1 is a top perspective view of a keymod mount for incorporating with a firearm having a keymod slot according to a preferred embodiment of the present invention.
Figure 2:
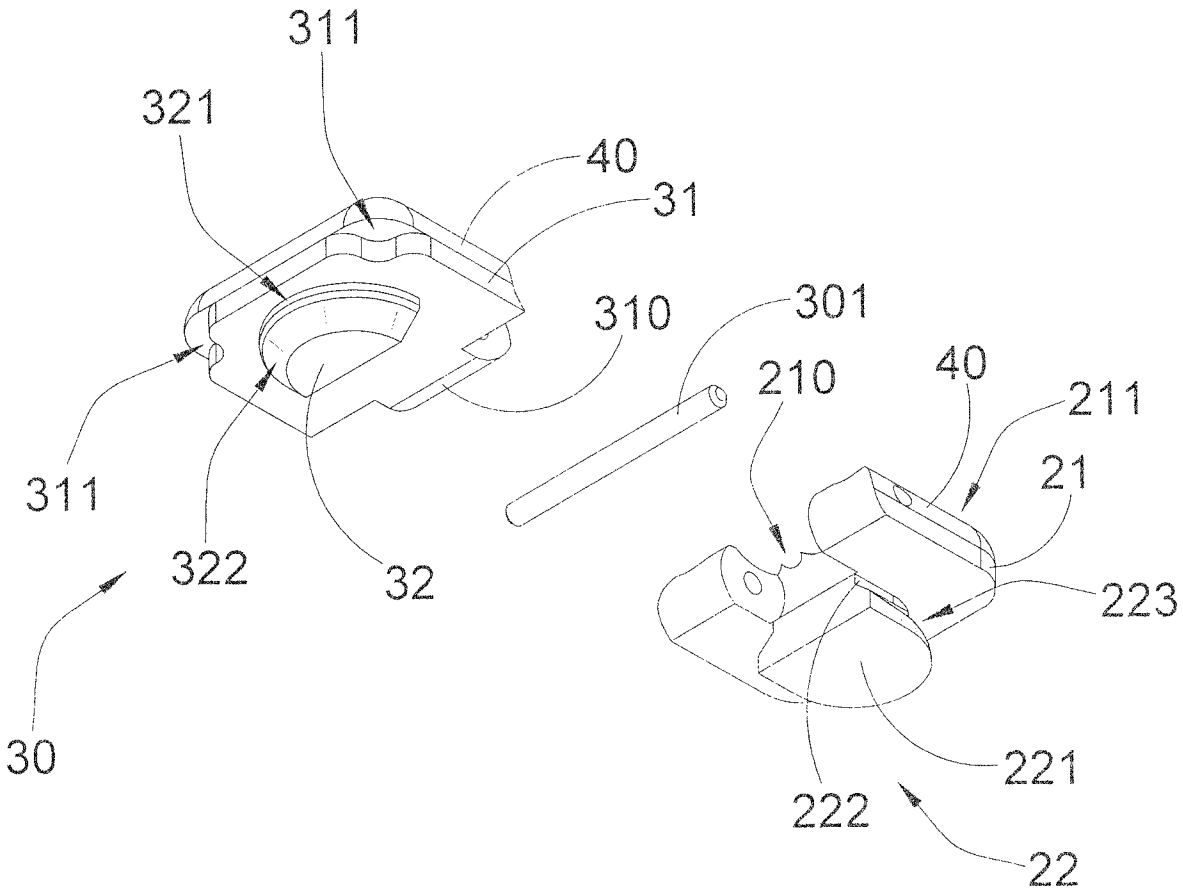
FIG. 2 is a bottom exploded perspective view of the keymod mount according to the above preferred embodiment of the present invention.
Figure 3:
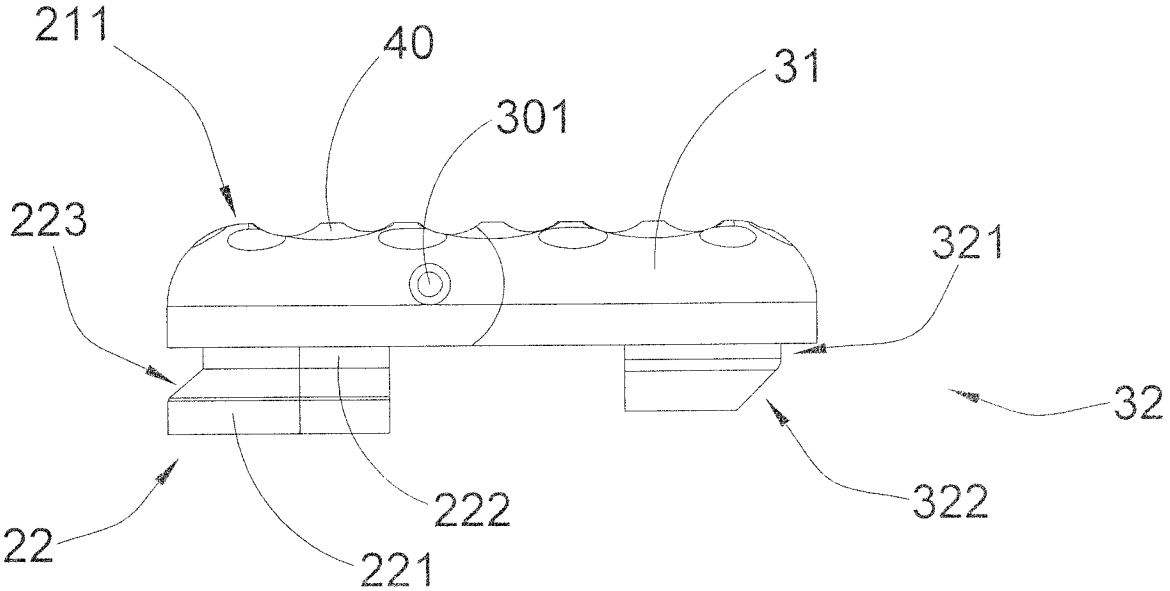
FIG. 3 is a side view of the keymod mount according to the above preferred embodiment of the present invention.

Referring to FIGS. 1 to 3 of the drawings, a keymod mount according to a preferred embodiment of the present invention is illustrated, wherein the keymod mount of the present invention is adapted for detachably coupling at a firearm having one or more keymod slots 10.

Accordingly, the keymod slots 10 can be formed at a top side of the firearm, a bottom side of a barrel of the firearm, or at a handguard of the firearm. For better illustration, the handguard is used as an example to show the attachment between the keymod mount and the keymod slot 10. It should be appreciated that the keymod mount of the present invention can be coupled at the keymod slot 10 at any location of the firearm.

Each of the keymod slots 10 has a Keyhole configuration to define an enlarged slot portion 11 and a narrow slot portion 12, wherein the keymod slot 10 further has a slanted bottom surface 13 formed at the narrow slot portion 12 to form a the chamfered configuration.

According to the preferred embodiment, the keymod mount is arranged for detachably coupling at one or more keymod slots 10 of the firearm to provide an additional function, such as a slot cover or an accessory mount, for the firearm, wherein the keymod mount comprises a securing member 20 and a locking member 30 movably extended from the securing member 20.

The securing member 20 comprises a mounting body 21 having a top utility surface 211, and a coupling head 22 downwardly extended from a bottom surface of the mounting body 21 for slidably engaging with the narrow slot portion 12 of the keymod slot 10 to retain the mounting body on a top surface of the keymod slot 10.

Accordingly, the mounting body 21 has a thin planner structure and forms a low profile configuration to minimize a distance between the top utility surface 211 of the mounting body 21 and the top surface of the keymod slot 10. Preferably, the mounting body 21 is made of rigid but light weight material, such as plastic.

The coupling head 22 has an enlarged head portion 221 and an elongated neck portion 222 integrally extended from the bottom surface of the mounting body 21 to the enlarged head portion 221. A size of the enlarged head portion 221 of the coupling head 22 is slightly larger than a width of the narrow slot portion 12 of the keymod 10, and a size of the elongated neck portion 222 of the coupling head 22 is slightly smaller than the width of the narrow slot portion 12 of the keymod 10.

Therefore, the coupling head 22 can be slid to a far edge of the narrow slot portion 12 of the keymod 10 from the enlarged slot portion 11 thereof in order to engage with the narrow slot portion 12. In particular, the enlarged head portion 221 of the coupling head 22 is arranged for sliding under the narrow slot portion 12 of the keymod slot 10 to engage the enlarged head portion 221 of the coupling head 22 with the slanted bottom surface 13 of the keymod slot 10 so as to secure the mounting body on the top side of the keymod slot 10. Accordingly, the coupling head 22 further has a slanted engaging surface 223 formed at the enlarged head portion 221 to slidably engage with the narrow slot portion 12 of the keymod 10 with the chamfered configuration.

The locking member 30 comprises a locking body 31 movably extended from the mounting body 21 and a locking head 32 downwardly extended from a bottom surface of the locking body 31 for inserting into the enlarged slot portion 11 of the keymod slot 10 after the coupling head 22 is engaged with the narrow slot portion 12 thereof, so as to securely lock up the securing member 20 on the firearm.

The locking body 31 also has a thin planner structure and forms a low profile configuration to minimize a distance between a top surface of the locking body 31 and the top surface of the keymod slot 10. Preferably, the locking body 31 is also made of rigid but light weight material, such as plastic. Preferably, the mounting body 21 and the locking body 31 have the same thickness, such that the mounting body 21 and the locking body 31 form a flat top side when the mounting body 21 and the locking body 31 are rested on the top side of the keymod slot 10.

The locking head 32 has a curved engaging surface 321 matching with an edge curvature of the enlarged slot portion 11 of the keymod slot 10, and a slanted guiding surface 322 extended to the curved engaging surface 321 to guide the curved engaging surface 321 to engage with the enlarged slot portion 11 of the keymod slot 10. Accordingly, the curved engaging surface 321 is located close to the bottom surface of the locking body 31, wherein the slanted guiding surface 322 is inclinedly extended from a bottom side of the locking head 32 to the curved engaging surface 321, such that a cross section of the locking head 32 is gradually reduced from the bottom side thereof toward the curved engaging surface 321. Therefore, when the locking head 32 is inserted into the enlarged slot portion 11 of the keymod 10, the slanted guiding surface 322 of the locking head 32 is guided to slide at the far edge of the enlarged slot portion 11 of the keymod 10 until the curved engaging surface 321 of the locking head 32 is engaged with the far edge of the enlarged slot portion 11 of the keymod 10. It is worth mentioning that when the coupling head 22 is slid to engage with the far edge of the narrow slot portion 12 of the keymod slot 10 and the locking head 22 is engaged with the far edge of the enlarged slot portion 11 of the keymod slot 10, the coupling head 22 and the locking head 32 are engaged with two opposite ends of the keymod slot 10 so as to prevent the keymod mount being longitudinally moved on the keymod slot 10.

The locking body 31 is movably extended from the mounting body 21 edge-to-edge. Both of the mounting body 21 and the locking body 31 preferably have either a square shape or rectangular shape. In particular, a transverse edge of the locking body 31 is movably extended from a corresponding transverse edge of the mounting body 21.

According to the preferred embodiment, the locking member 30 is pivotally coupled with the securing member 20 via a pivot joint 301, such that when the locking body 31 is pivotally folded on the top side of the keymod slot 10, the locking head 32 is arranged for inserting into the enlarged slot portion 11 of the keymod slot 10 after the coupling head 22 is slid to engage with the narrow slot portion 12 of the keymod slot 10.

As shown in FIG. 2, the mounting body 21 further has an indented cavity 210 indented at the transverse edge of the mounting body 21. The locking body 31 further has a protrusion portion 310 integrally protruded from the transverse edge of the locking body 31, wherein the protrusion portion 310 of the locking body 31 fits into the indented cavity 210 of the mounting body 21. The pivot joint 301 comprises a pivot axle transversely extended through the mounting body 21 and the locking body 31 so as to enable the protrusion portion 310 of the locking body 31 to pivotally move at the indented cavity 210 of the mounting body 21.

As shown in FIGS. 2 and 3, the locking body 31 further has an indented edge portion 311 formed underneath a top surface of the locking body 31 and above the top side of the keymod slot 10 when the locking body 31 is rested on the top side of the keymod slot 10. Preferably, the indented edge portion 311 is formed at each corner portion of the locking body 31 at a free transverse edge thereof which is opposite to the transverse edge of the locking body 31 extended from the mounting body 21. Therefore, after the locking body 31 is pressed on the top side of the keymod slot 10 to insert the locking head 22 at the enlarged slot portion 11 of the keymod slot 10, the locking body 31 is enabled to move away from the top side of the keymod slot 10 by an upward peeling force so as to detach the locking head 22 from the enlarged slot portion 11 of the keymod slot 10.

As shown in FIGS. 1 to 4, the keymod mount of the present invention is arranged to detachably couple at one keymod slot 10. In other words, the coupling head 22 and the locking head 32 are engaged with the narrow slot portion 11 and the enlarged slot portion 12 of the same keymod slot 10. In particularly, a distance between the coupling head 22 and the locking head 32 matches with a distance between the narrow slot portion 12 and the enlarged slot portion 11 of the same keymod slot 10.

Figure 4:
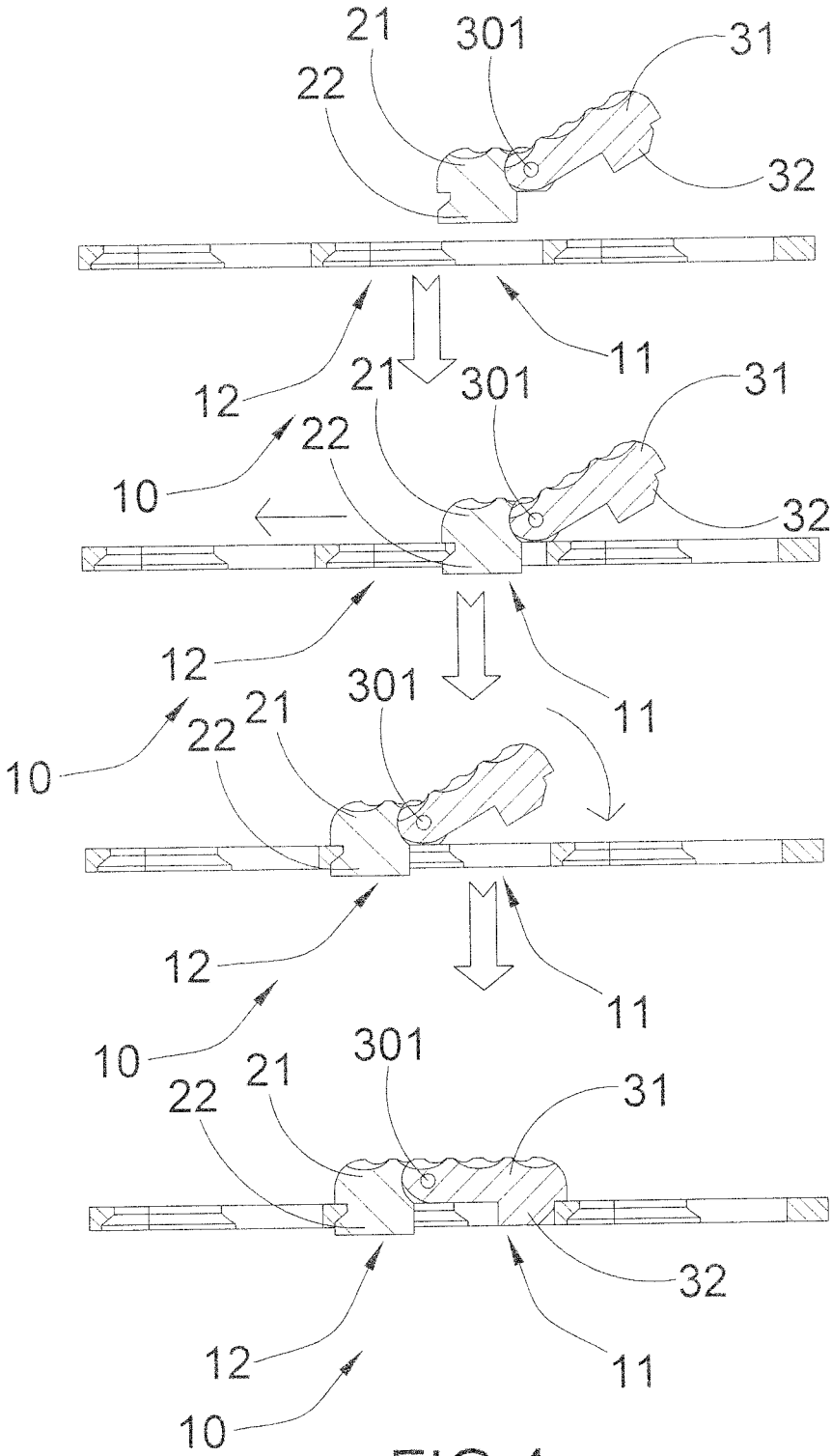
FIG. 4 illustrates an operation of the keymod mount to mount and dismount to the keymod slot according to the above preferred embodiment of the present invention.

As shown in FIG. 4, the locking body 31 is pivotally lifted to inclinedly extend from the mounting body 21, such that the coupling head 22 can be disposed in the enlarged slot portion 11 of the keymod slot 10. After the coupling head 22 is slid from the enlarged slot portion 11 of the keymod slot 10 to engage with the narrow slot portion 12 thereof, the locking body 31 is folded on the top side of the keymod slot 10 to insert the locking head 32 into the enlarged slot portion 11 of the keymod slot 10.

According to the preferred embodiment, the keymod mount serves as a handguard cover, wherein a heat resistant cushioning layer 40 is provided on the top utility surface 211 of the mounting body 21 of the securing member 20. Therefore, the keymod mount of the present invention will not only provide a comfort touching and non-scratching protection layer on the handguard but also block the heat generated from the barrel through the handguard. It is worth mentioning that the user is able to couple two or more keymod mounts on the handguard to cover the keymod slots 10 in order to form the handguard cover according to the hand size of the user. Therefore, the handguard cover is customized to fit the hand size of the user when the user grips the handguard. The uncovered keymod slots will form the heat dissipating slots for heat dissipation. Preferably, the heat resistant cushioning layer 40 is also provided on the top side of the locking body 31.

For detaching the keymod mount of the present invention from the keymod slot 10, the locking body 31 can be pivotally lifted to detach the locking head 32 from the enlarged slot portion 11 of the keymod 10. Therefore, by sliding the mounting body 21 toward the enlarged slot portion 11 of the keymod 10, the coupling head 22 is driven to slide from the narrow slot portion 12 of the keymod 10 to the enlarged slot portion 11 thereof. As a result, the keymod mount can be detached from the firearm.

Figure 5:
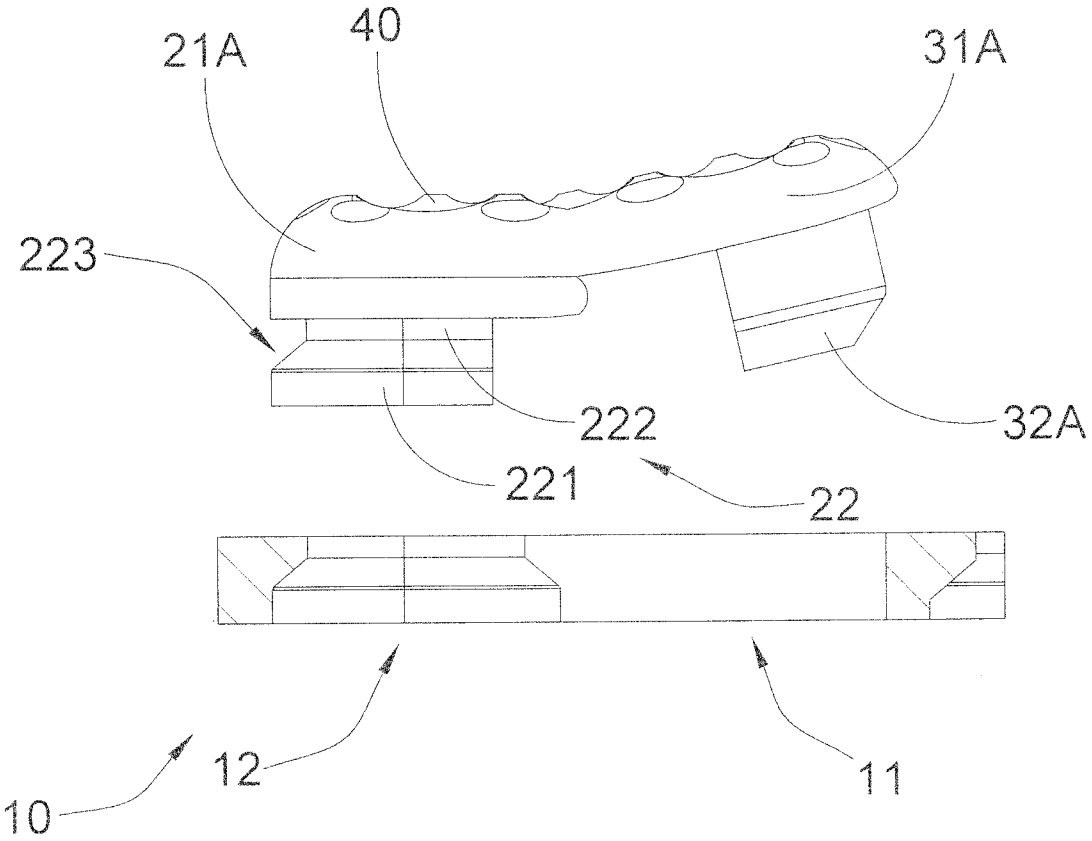
FIG. 5 illustrates a first alternative mode of the keymod mount according to the above preferred embodiment of the present invention, illustrating the elastic locking head.

FIG. 5 illustrates a first alternative mode of the keymod mount which has the same structural configuration except the locking body 31A is integrally extended from the mounting body 21A. Accordingly, the mounting body 21A and the locking body 31A is made of flexible material, such a rubber, such that the locking body 31A can be bent with respect to the mounting body 21A. The coupling head 22 is made of rigid material and is extended from the bottom surface of the mounting body 21A. The locking head 22 is also made of elastic material, such as rubber, and is integrally extended from the bottom surface of the locking body 31A. In particular, a size of the locking head 22A is slightly larger than a size of the enlarged slot portion 11 of the keymod slot 10. Therefore, after the coupling head 22 is slid from the enlarged slot portion 11 of the keymod slot 10 to engage with the narrow slot portion 12 thereof, the locking body 31A is pressed on the top side of the keymod slot 10 to plug the locking head 32A into the enlarged slot portion 11 of the keymod slot 10, so as to engage the locking head 32A with the enlarged slot portion 11 of the keymod slot 10 by means of elastic force. Likewise, due to the flexibility of the locking body 31A, the locking body 31A can be lifted up from the top side of the keymod slot 10 to detach the locking head 32A from the enlarged slot portion 11 of the keymod slot 10 while the coupling head 22 is remained engaged with the narrow slot portion 12 of the keymod slot 10. Once the locking head 32A is removed from the enlarged slot portion 11 of the keymod slot 10, the mounting body 21A can be slid toward the enlarged slot portion 11 of the keymod 10 to drive the coupling head 22 is to slide from the narrow slot portion 12 of the keymod 10 to the enlarged slot portion 11 thereof. As a result, the keymod mount can be detached from the firearm.

Figure 6A:
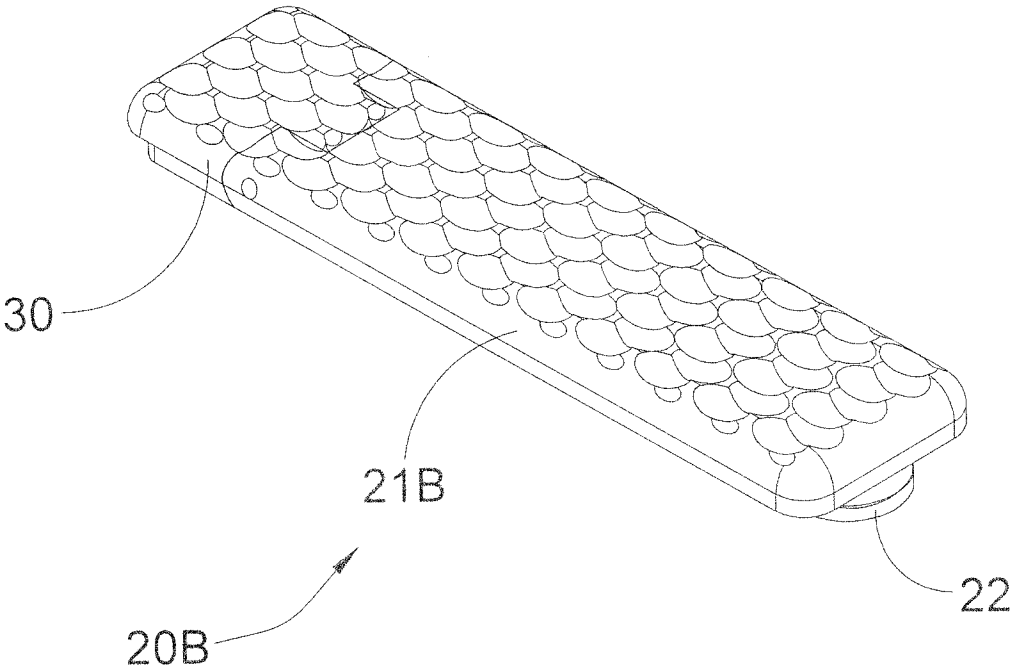
FIGS. 6A and 6B illustrate a second alternative mode of the keymod mount according to the above preferred embodiment of the present invention, illustrating the keymod mount mounting to a series of keymod slots.
Figure 6B:
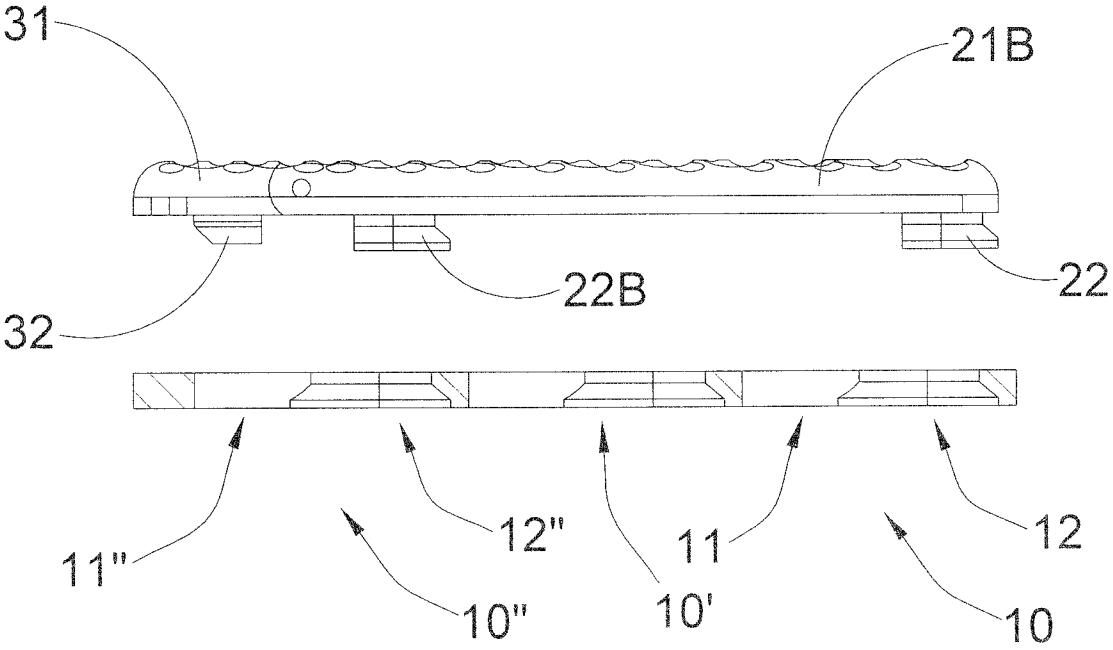

FIGS. 6A and 6B illustrate a second alternative mode of the keymod mount which can mount to a series of keymod slots 10. For example, the handguard has a plurality of longitudinal faces, wherein the series of keymod slots 10 are formed at each of the longitudinal faces of the handguard. The keymod slots 10 are aligned at the same direction such that centerlines of the keymod slots 10 are aligned at the same axis direction.

As shown in FIGS. 6A and 6B, the length of the mounting body 21B is larger than the length of each of the keymod slots 10. In particular, the length of the mounting body 21B of the securing member 20B will cover at least two adjacent keymod slots 10. Therefore, when the coupling head 22 is slid from the enlarged slot portion 11 of the first keymod slot 10 to engage with the narrow slot portion 12 thereof, the mounting body 21B will cover on the top sides of the first and second keymod slots 10, 10'. The locking body 31 of the securing member 30 is pivotally coupled with the mounting body 21B and is pivotally moved to drive the locking head 32 to engage with the enlarged slot portion 11" of the third keymod slot 10", so as to securely lock up the mounting body 21B on the firearm. In other words, the mounting body 21B and the locking body 31 will cover the first, second, and third keymod slots 10, 10', 10" in series. It should be appreciated that the length of the mounting body 21B can be configured to cover three or more keymod slots 10 in series. In addition, it should be appreciated that the mounting body 21B and the locking body 31 can be made of flexible material as the first alternative mode to engage the locking head 32 with the enlarged slot portion 11" of the third keymod slot 10" by means of elastic force, such that the locking body 31 is integrally extended from the mounting body 21B and bendable with respect to the mounting body 21B.

As shown in FIG. 6B, since the length of the mounting body 21B is prolonged, an additional coupling head 22B is downwardly extended from the mounting body 21B to further enhance the securely attachment of the mounting body 21B. The structural configuration of the additional coupling head 22B is the same as that of the coupling head 22B. The additional coupling head 22B is preferably located at the mounting body 21B close to the locking body 31B.

Therefore, when the coupling head 22 is engaged with the narrow slot portion 12 of the first keymod slot 10, the addition coupling head 22B will be engaged with the narrow slot portion 12" of the first keymod slot 10", as shown in FIG. 6B. It is worth mentioning that when the coupling head 22 and the additional coupling head 22B are engaged with the narrow slot portion 12, 12" of the first and third keymod slot 10, 10" respectively, the locking head 32 is automatically aligned with the enlarged slot portion 11" of the third keymod slot 10" when the locking body 31 is pressed on the top side of the third keymod slot 10".

It is worth mentioning that the addition coupling head 22B serves as a positioning member to engage with another Keymod slot 10", so as to ensure the corrected alignment between the Keymod mount and the firearm and to prevent any unwanted longitudinal and/or rotational movement of the Keymod mount with respect to the firearm after the Keymod mount is mounted to the firearm.

Figure 7A:
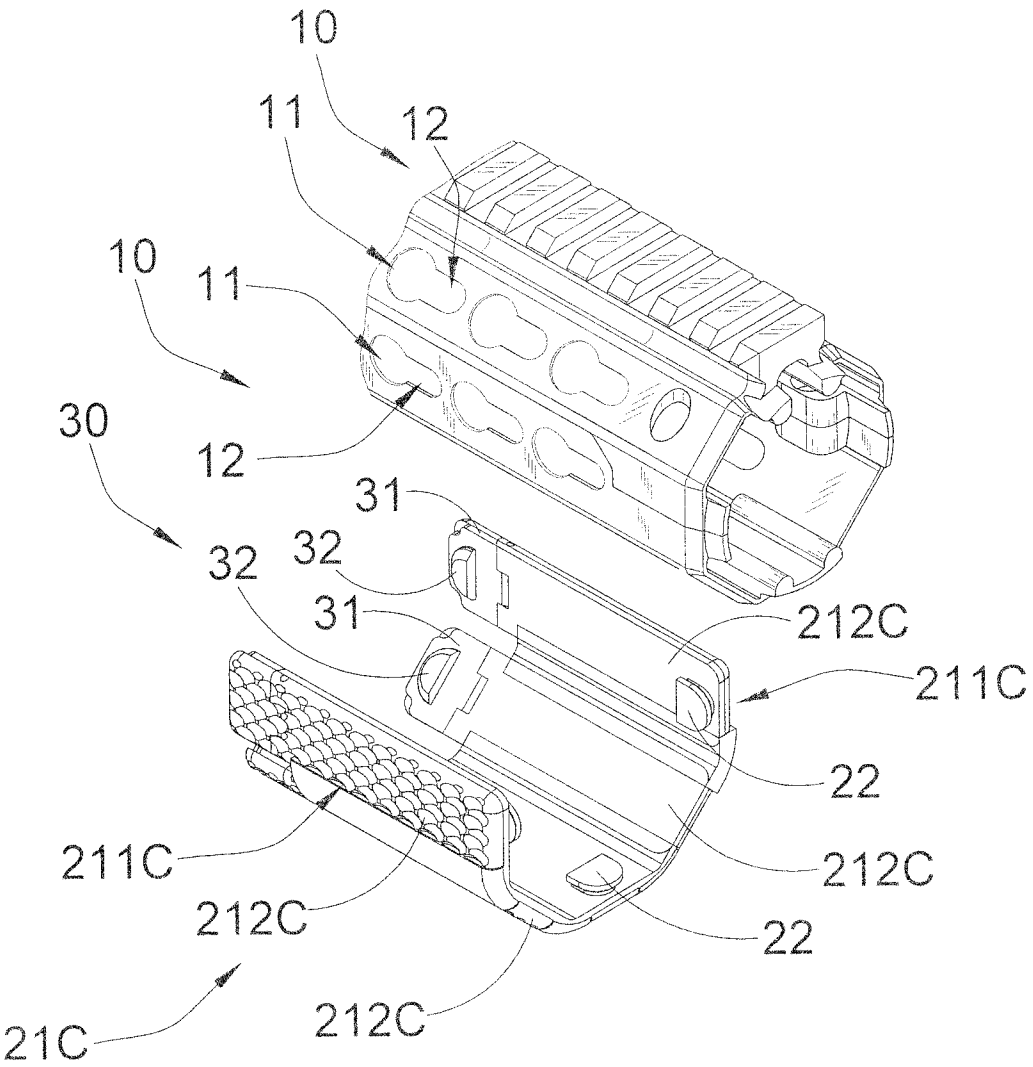
FIGS. 7A and 7B illustrate a third alternative mode of the keymod mount according to the above preferred embodiment of the present invention, illustrating the keymod mount mounting to the keymod slots at different longitudinal faces of the handguard.
Figure 7B:
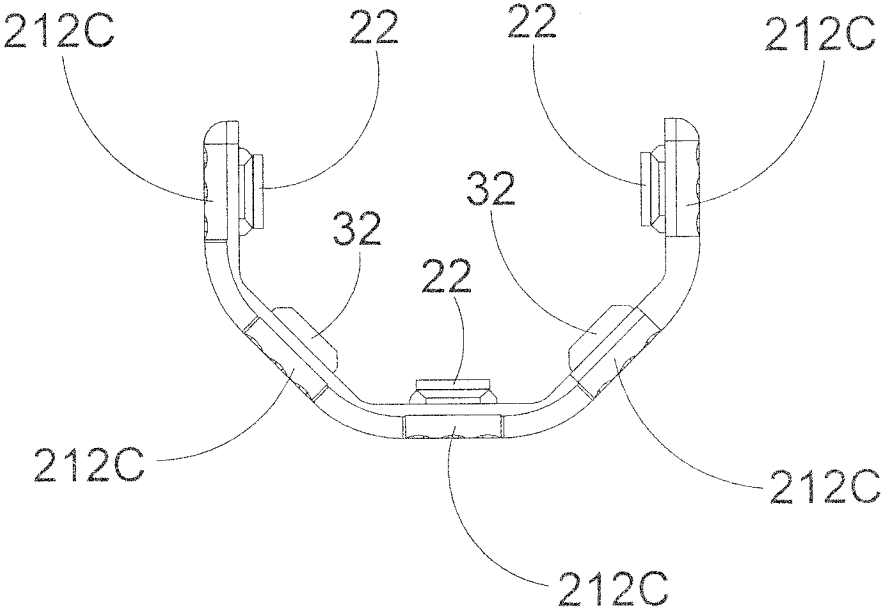

FIGS. 7A and 7B illustrate a third alternative mode of the keymod mount which can mount to the keymod slots 10 at different longitudinal faces of the handguard. For example, the keymod mount can cover the keymod slots 10 at different longitudinal faces of the handguard, as shown in FIG. 7A.

Accordingly, the mounting body 21C has a plurality of longitudinal mounting portions 212C integrally extended side-by-side in an angled manner to define the top utility surface 211C on each of the longitudinal mounting portions 212C. The angle between two adjacent longitudinal mounting portions 212C matches with the angle between two adjacent longitudinal faces of the handguard. For example, five longitudinal mounting portions 212C of the mounting body 21C are integrally extended side-by-side to cover five different longitudinal faces of the handguard respectively.

The coupling head 22 is extended from the bottom surface of at least one of the longitudinal mounting portions 212C to engage with at least one of the keymod slots 10. Preferably, the coupling heads 22 are provided at the longitudinal mounting portions 212C in an alternating manner. In other words, the coupling heads 22 are provided at the first, third, and fifth longitudinal mounting portions 212C respectively, such that the coupling heads 22 will engage with the narrow slot portions 12 of the keymod slots 10 at the first, third, and fifth longitudinal faces of the handguard respectively. It is worth mentioning that only one coupling head 22 can be provided to engage with the narrow slot portion 12 of the keymod slot 10 for retaining the longitudinal mounting portions 212C in position on the handguard.

The locking member 30 is movably extended from at least one of the longitudinal mounting portions 212C of the mounting body 21C. In other words, at least one locking body 31 is movably extended from one of the longitudinal mounting portions 212C of the mounting body 21C in order to drive the locking head 32 to engage with the enlarged slot portion 11 of the keymod slot 10. As shown in FIGS. 7A and 7B, the locking body 31 is movably extended from each of the longitudinal mounting portions 212C of the mounting body 21C, such that the locking heads 32 will engage with the enlarged slot portions 11 of the keymod slots 10 at different longitudinal faces of the handguard respectively. Accordingly, the coupling head 22 and the locking head 32 can be engaged with the keymod slots 10 at the same longitudinal face of the handguard or can be engaged with the keymod slots 10 at different longitudinal faces of the handguard. Preferably, the coupling head 22 and the locking head 32 are alternating with each other with respect to the longitudinal mounting portions 212C of the mounting body 21C. For example, when the coupling heads 22 are provided at the first, third, and fifth longitudinal mounting portions 212C respectively, the locking members 30 can be extended from the second and fourth longitudinal mounting portions 212C respectively.

Figure 8A:
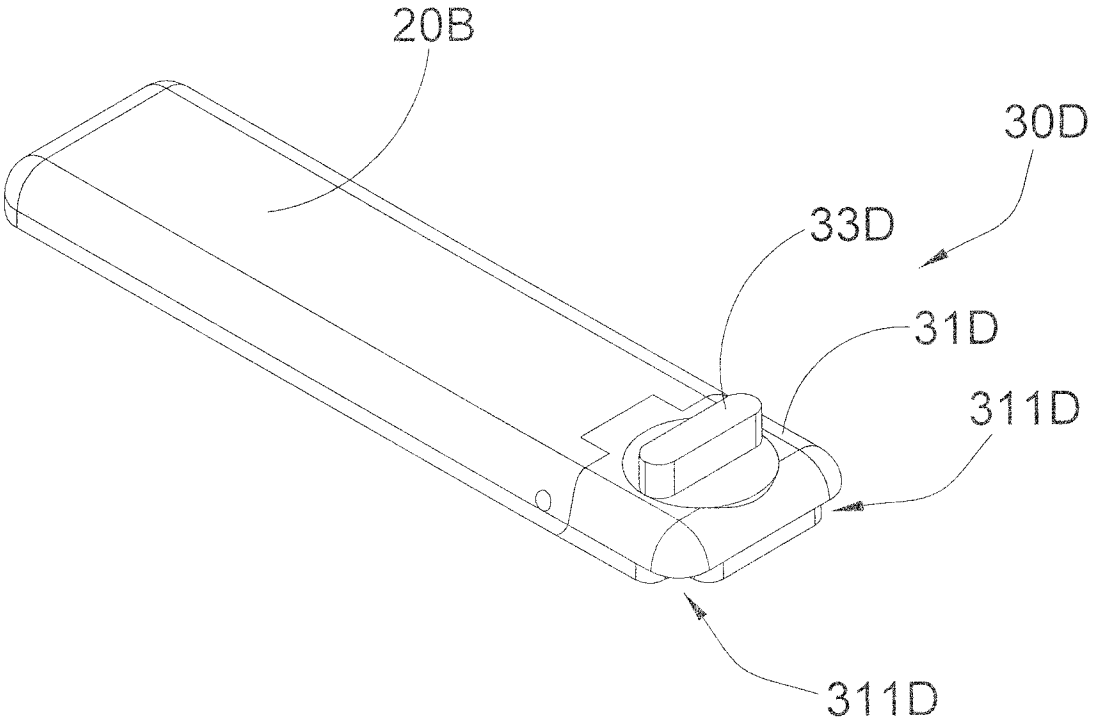
FIGS. 8A, 8B, and 8C illustrate a fourth alternative mode of the keymod mount according to the above preferred embodiment of the present invention, illustrating the rotatable locking head.
Figure 8B:
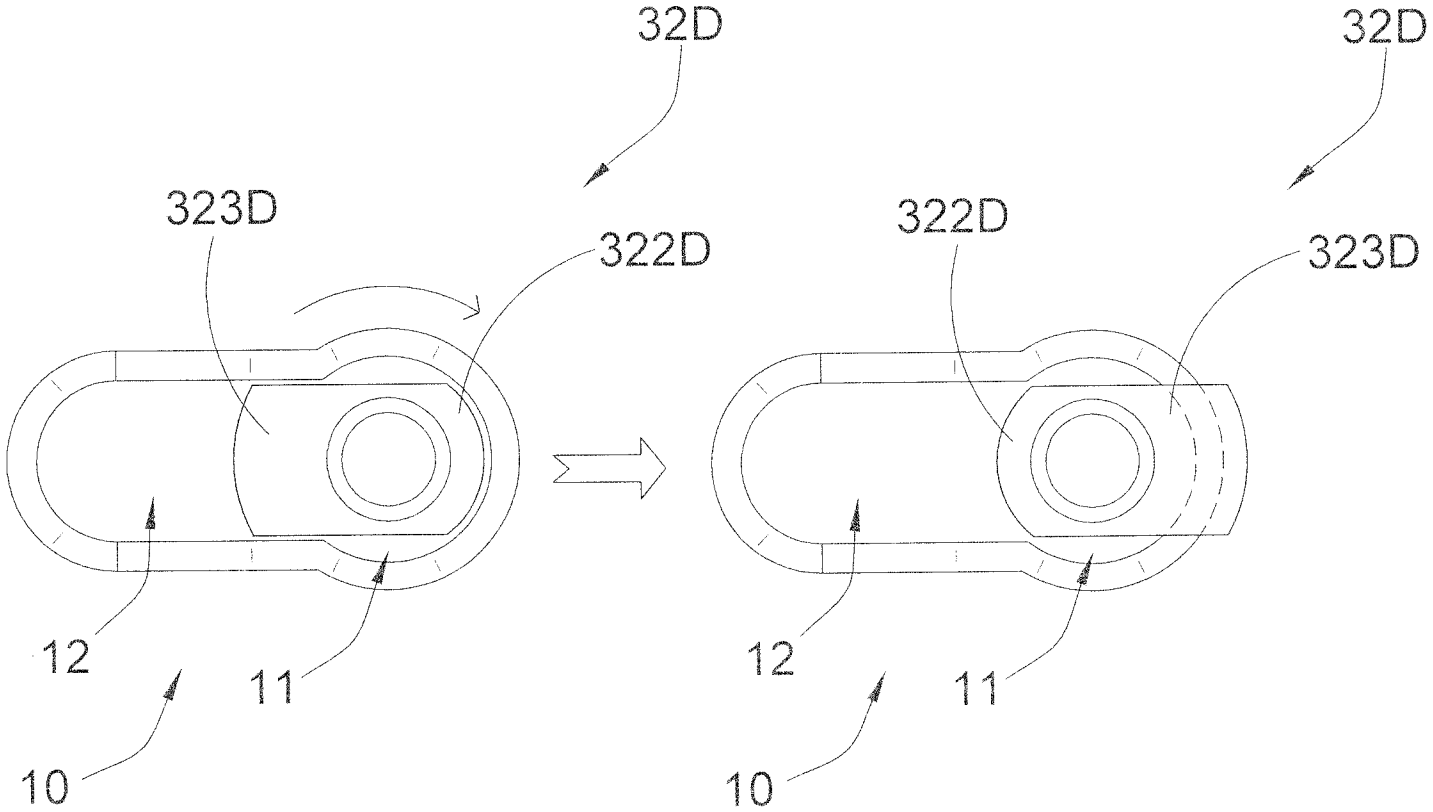
Figure 8C:
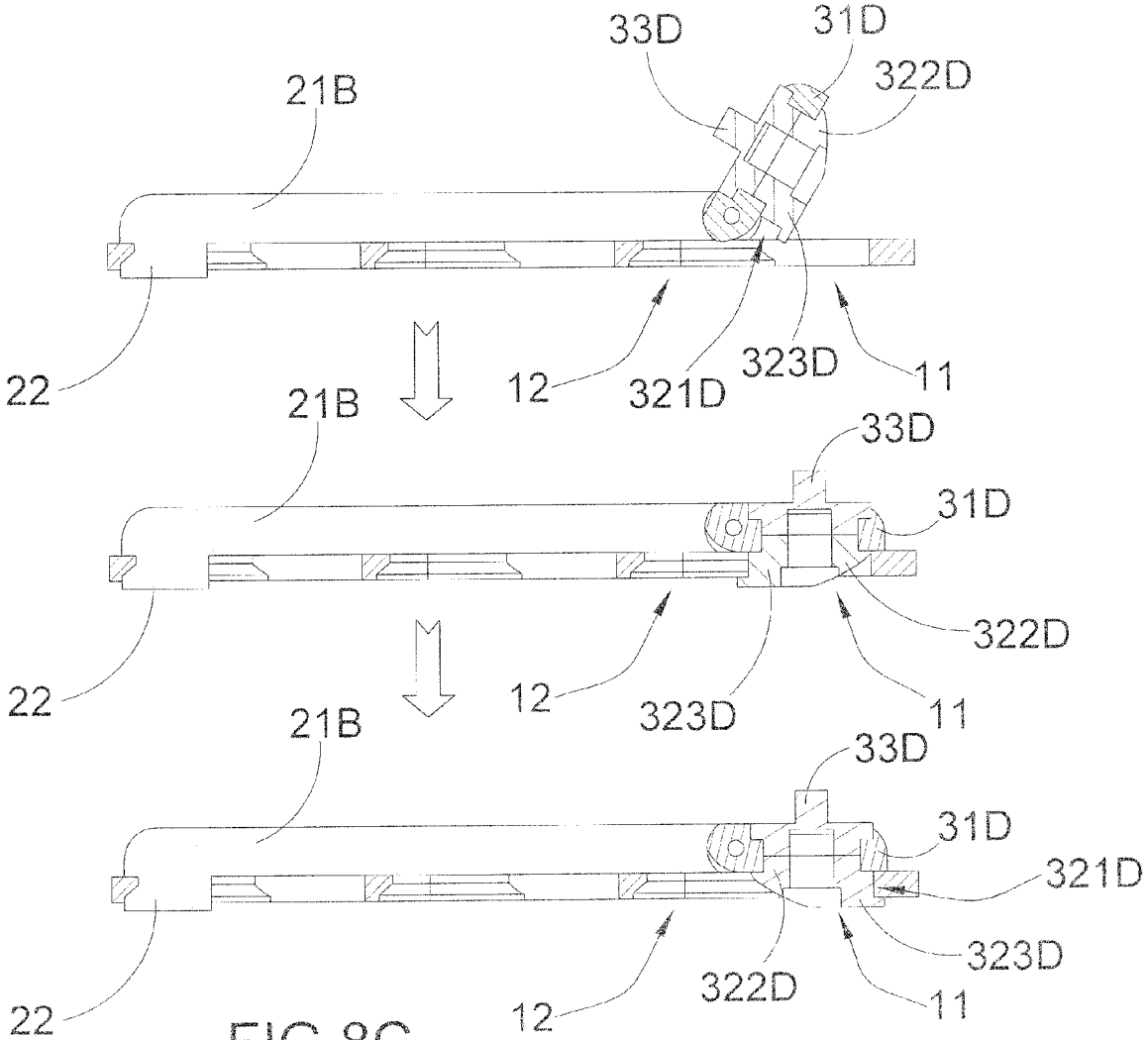

FIGS. 8A to 8C illustrate a fourth alternative mode of the locking member 30D of the keymod mount, wherein the locking member 30D is movably extended from, preferably pivotally coupled at, the securing member 20B. In particular, the locking member 30D comprises a locking body 31D movably extended from the mounting body 21 and a locking head 32D downwardly extended from a bottom surface of the locking body 31D for inserting into the enlarged slot portion 11 of the keymod slot 10 after the coupling head 22 is engaged with the narrow slot portion 12 thereof. The locking body 31D further has an indented edge portion 311D formed underneath a top surface of the locking body 31D and above the top side of the keymod slot 10 when the locking body 31D is rested on the top side of the keymod slot 10.

Accordingly, the locking head 32D is rotatably extended from the bottom side of the locking body 31D to selectively lock up with the enlarged slot portion 11 of the keymod slot 10. As shown in FIG. 8B, the locking head 32D has an elongated locking wing portion and defines the curved engaging surface 321D thereat. When the locking head 32D is rotated, the curved engaging surface 321D is moved to engage with the far edge of the enlarged slot portion 11 of the keymod slot 10 while the locking wing portion is moved at the bottom side of the enlarged slot portion 11 of the keymod slot 10, so as to lock up the locking head 32D at the enlarged slot portion 11 of the keymod slot 10.

In particular, the locking head 32D having an elongated configuration defines a to short wing portion 322D and a long wing portion 323D which has a length longer than a length of the short wing portion 322D, wherein the long wing portion 323D serves as the locking wing portion. A rotatable point of the locking head 32D is defined between the short wing portion 322D and the short wing portion 323D. A width of the locking head 32D is slightly smaller than a width of the narrow slot portion 12 of the keymod slot 10.

As shown in FIGS. 8B and 8C, when the locking head 32D is disposed in the enlarged slot portion 11 of the keymod slot 10, the long wing portion 323D of the locking head 32D is extended toward the narrow slot portion 12 of the keymod slot 10. Therefore, a free end of the short wing portion 322D of the locking head 32D is located apart from the far edge of the enlarged slot portion 11 of the keymod slot 10, i.e. the releasing position of the locking head 32D. After the locking head 32D is disposed in the enlarged slot portion 11 of the keymod slot 10, the locking head 32D is rotated at a position that the short wing portion 322D of the locking head 32D is extended toward the narrow slot portion 12 of the keymod slot 10, i.e. the locking position of the locking head 32D. In other words, the curved engaging surface 321D of the locking head 32D is engaged with the far edge of the enlarged slot portion 11 of the keymod slot 10 while of the long wing portion 323D is moved to engage with the bottom side of the keymod slot 10, so as to lock up the locking head 32D at the enlarged slot portion 11 of the keymod slot 10. Preferably, the locking head 32D is rotated 180 degrees between the releasing position and the locking position. Preferably, the short wing portion 322D has a slanted guiding surface being guided to slide at the far edge of the enlarged slot portion 11 of the keymod 10 when the locking head 32D is disposed thereat.

In order to move the locking head 32D between the releasing position and the locking position, the locking member 30D further comprises a locker handle 33D extended from the top side of the locking body 31D and operatively linked to the locking head 32D. Preferably, the locker handle 33D is upwardly extended from the rotatable point of the locking head 32D, such that when the locker handle 33D is rotated manually, the locking head 32D is driven to rotate between the releasing position and the locking position.

Figure 9A:
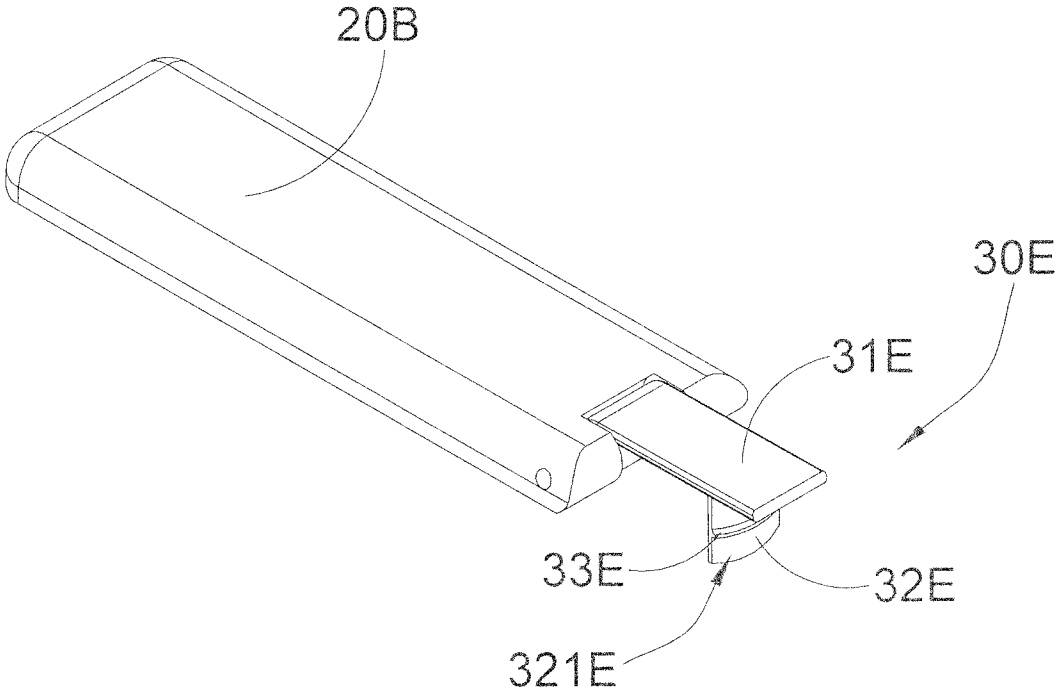
FIGS. 9A and 9B illustrate a fifth alternative mode of the keymod mount according to the above preferred embodiment of the present invention, illustrating the flexible locking head.
Figure 9B:
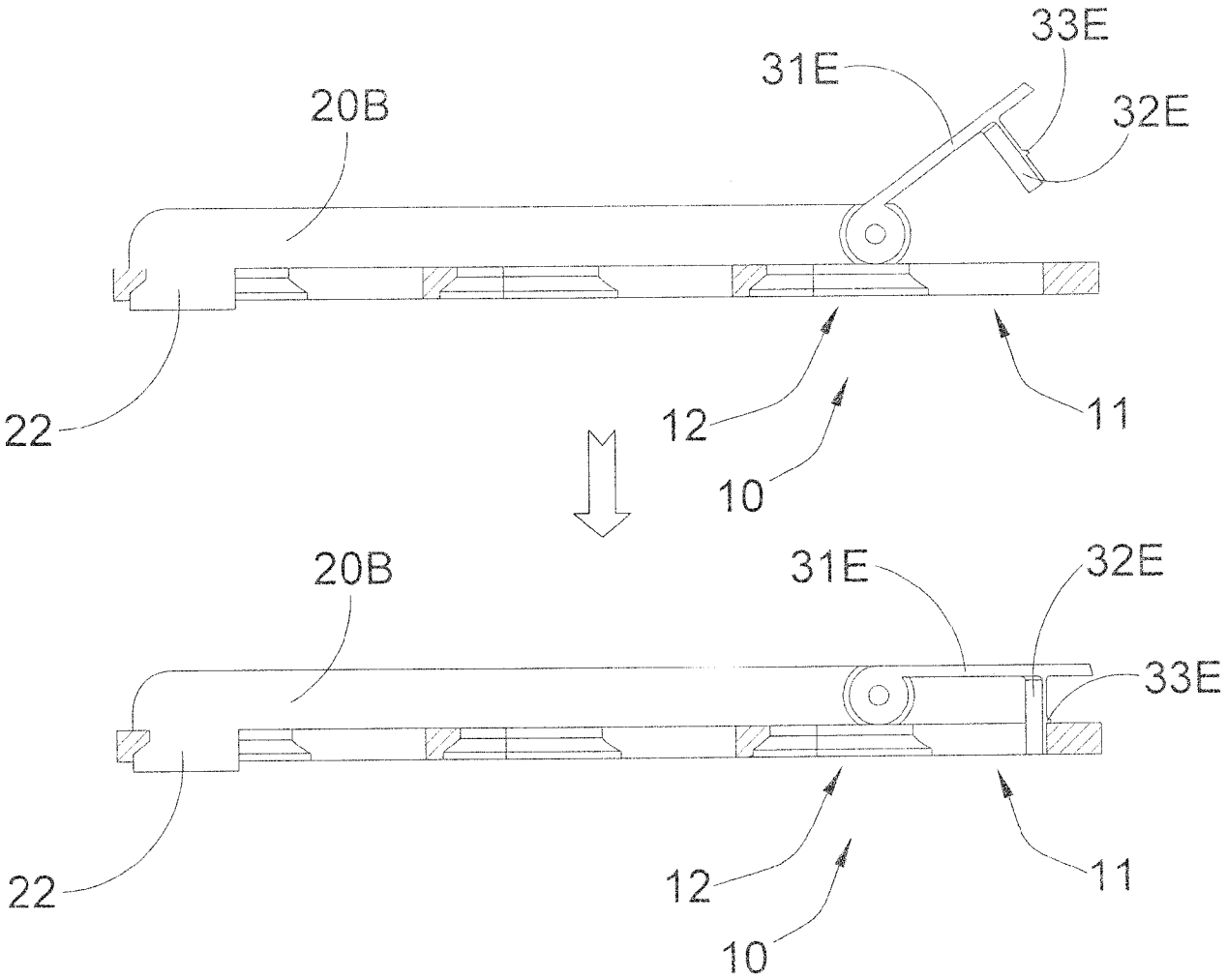

FIGS. 9A and 9B illustrate a fifth alternative mode of the locking member 30E of the keymod mount, wherein the locking member 30E is movably extended from, preferably pivotally coupled at, the securing member 20B. In particular, the locking member 30E comprises a locking body 31E movably extended from the mounting body 21 and a locking head 32E downwardly extended from a bottom surface of the locking body 31E for inserting into the enlarged slot portion 11 of the keymod slot 10 after the coupling head 22 is engaged with the narrow slot portion 12 thereof.

Accordingly, the locking body 31E and the locking head 32E are made of rigid but flexible material such as metal. Preferably, the locking body 31E is pivotally coupled with the mounting body 21, wherein the locking head 32E is integrally extended from the locking body 31E. The flexibility of the locking head 32E will generate a spring force to bias against the far edge of the enlarged slot portion 11 of the keymod slot 10.

In particular, the locking head 32E has a curved configuration to define the curved engaging surface 321E for engaging with the far edge of the enlarged slot portion 11 of the keymod slot 10 by means of spring force so as to lock up the locking head 32E at the enlarged slot portion 11 of the keymod slot 10.

As shown in FIG. 9B, when the locking body 31E is pressed to insert the locking head 32D into the enlarged slot portion 11 of the keymod slot 10, the locking head 32E is biased against and is slightly bent at the far edge of the enlarged slot portion 11 of the keymod slot 10. Therefore, the locking head 32E will generate the spring force to engage the curved engaging surface 321E with the far edge of the enlarged slot portion 11 of the keymod slot 10 so as to lock up the locking head 32E at the enlarged slot portion 11 of the keymod slot 10. In other words, when a peeling force is applied at the locking body 31E to overcome the spring force of the locking head 32E, the locking head 32E will be disengaged with the far edge of the enlarged slot portion 11 of the keymod slot 10, so as to enable the coupling head 22 to be slid back to the enlarged slot portion 11 of the keymod slot 10.

The locking member 30E further comprises a guiding ridge 33E integrally protruded from the curved engaging surface 321E of the locking head 32E, wherein when the curved engaging surface 321E of the locking head 32E is engaged with the far edge of the enlarged slot portion 11 of the keymod slot 10, the guiding ridge 33E is moved to bias against the top side of the enlarged slot portion 11 of the keymod slot 10, so as to ensure the engagement between the curved engaging surface 321E of the locking head 32E and the enlarged slot portion 11 of the keymod slot 10. In other words, the guiding ridge 33E is stopped at the top side of the keymod slot 10. It is worth mentioning that when the guiding ridge 33E is moved at the top side of the enlarged slot portion 11 of the keymod slot 10, the locking body 31E is suspended and spaced apart from the top side of the keymod slot 10, such that a space between the locking body 31E and the top side of the keymod slot 10 serves as the above mentioned indented edge portion 311 to enable the peeling force to be applied at the locking body 31E.

As it is mentioned above, the heat resistant cushioning layer 40 is provided on the top utility surface 211 of the mounting body 21 to form the handguard cover. FIGS. 10 and 11 illustrate different firearm accessories formed on the top utility surface 211 of the mounting body 21.

Figure 10A:
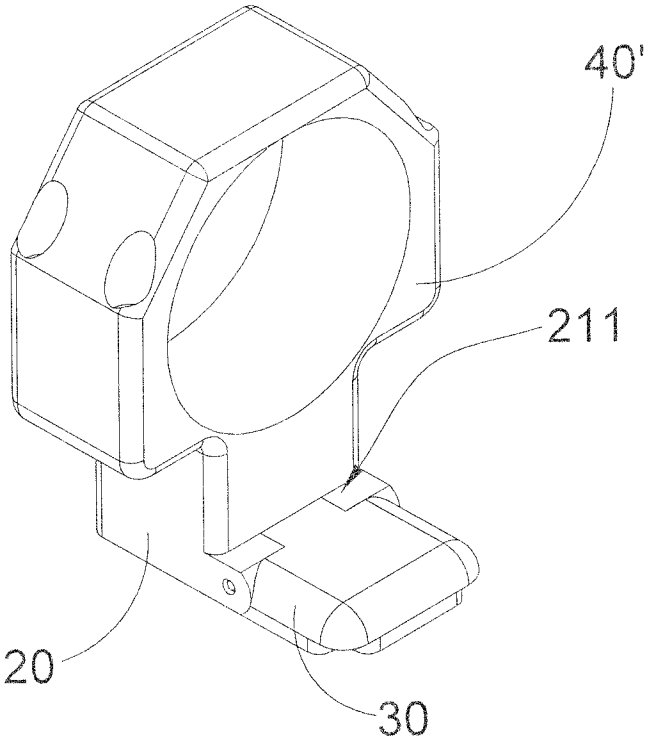
FIGS. 10A and 10B illustrate a first firearm accessory provided on the keymod mount according to the above preferred embodiment of the present invention.
Figure 10B:
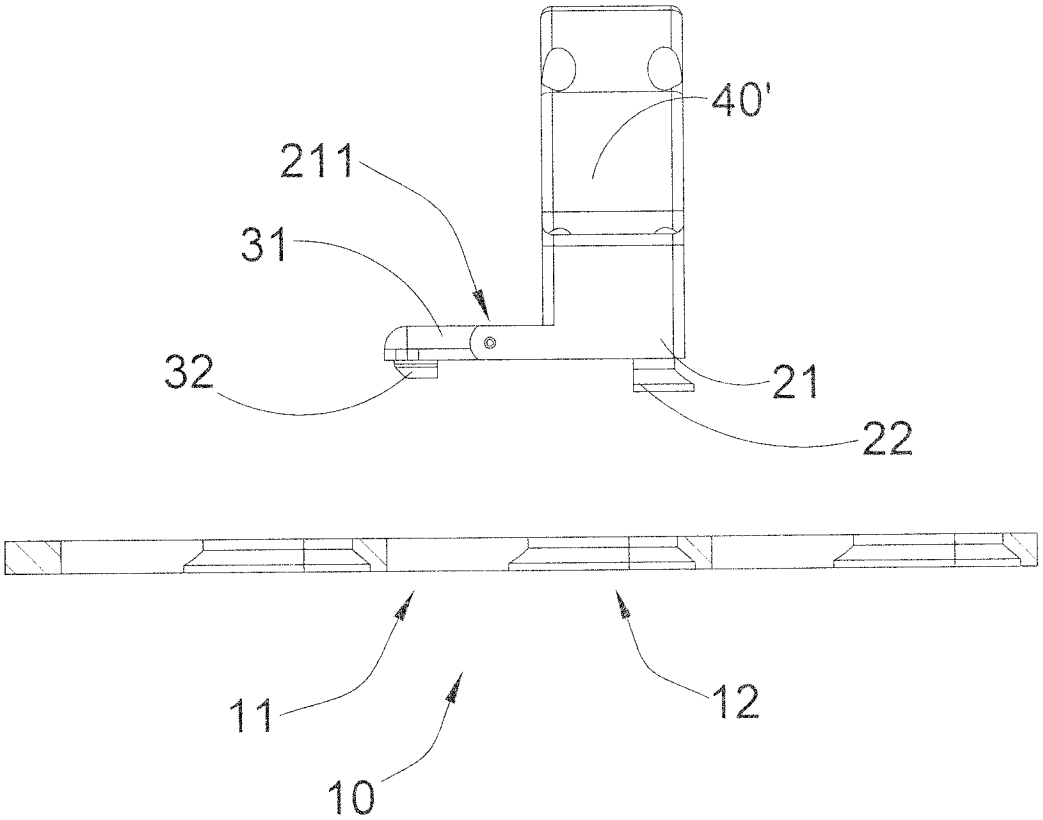

FIGS. 10A and 10B show a locker ring 40' as a firearm accessory integrally extended from the top utility surface 211 of the mounting body 21, such that when the mounting body 21 is coupled at the top side of the keymod slot 10, the locker ring 40' can be securely supported at the firearm. In addition, the locking member 30 is also locked at the keymod slot 10 to lock up the mounting body 21 so as to securely lock the locker ring 40' at the firearm. It is worth mentioning that two or more locker rings 40' can be spacedly mounted on the firearm via the keymod mounts of the present invention, such that the locker rings 40' are coaxially aligned with each other to lock any device, such as scope, navigation light module, or camera module, in order to mount the device on the firearm.

Figure 11A:
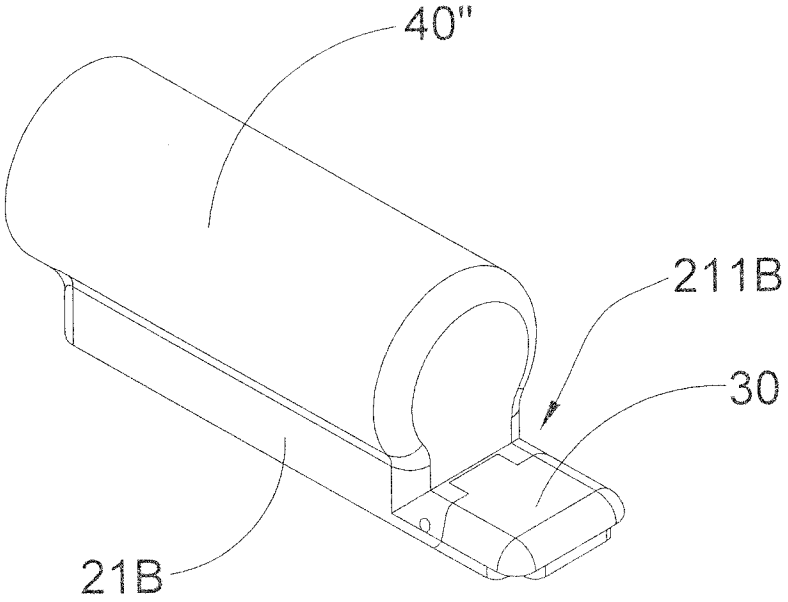
FIGS. 11A and 11B illustrate a second firearm accessory provided on the keymod mount according to the above preferred embodiment of the present invention.
Figure 11B:
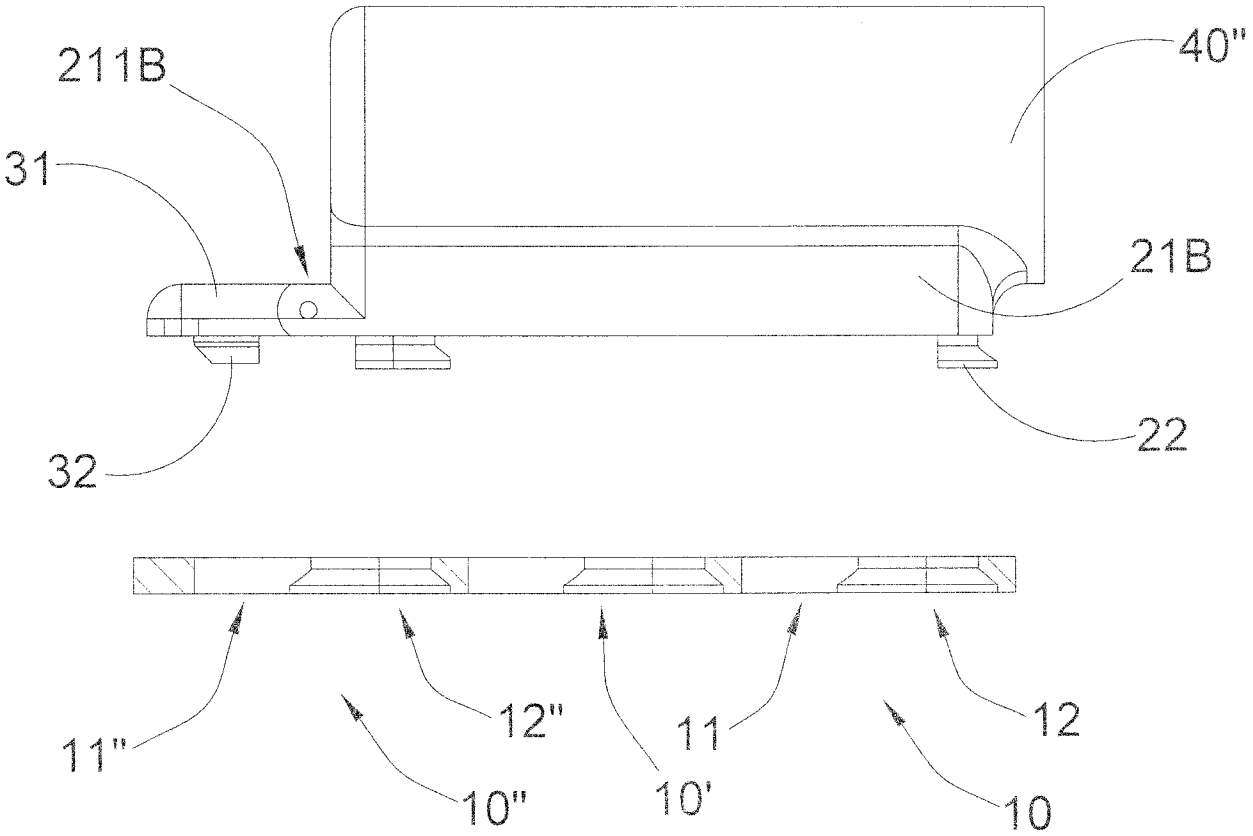

FIGS. 11A and 11B shows a flashlight module 40" as another firearm accessory integrally extended from the top utility surface 211B of the mounting body 21B, such that when the mounting body 21B is coupled at the top side of the keymod slot 10, the flashlight module 40" can be securely supported at the firearm. The flashlight module 40" is perfectly incorporated with the mounting body 21B because the length of the flashlight module 40" matches with the prolonged length of the mounting body 21B. It is worth mentioning that the locking member 30 is also locked at the keymod slot 10 to lock up the mounting body 21B so as to securely lock the flashlight module 40' at the firearm. In addition, the flashlight module 40" can be locked at any location of the firearm having the keymod slot 10. For example, the flashlight module 40" can be detachably mounted underneath the barrel of a handgun when the keymod slot 10 is provided at the bottom side of the barrel of the handgun.

It is worth mentioning that the above mentioned securing member 20 can be incorporated with different locking mechanisms of the locking member 30, including the insertion of the locking head 32 as shown in FIG. 4, the elastic locking head 32A as shown in FIG. 5, the rotatable locking head 32D as shown in FIGS. 8A to 8C, and the flexible locking head 32D with spring force as shown in FIGS. 9A and 9B. Each locking mechanism of the locking member 30 can also be incorporated with different configurations of the securing member 20, including the elongated mounting body 21B as shown in FIGS. 6A and 6B and the mounting body 21C with different longitudinal mounting portions 212C as shown in FIGS. 7A and 7B.

In other words, the structural configurations of the securing member 20 and the locking member 30 of the embodiment and its alternative modes are interchangeable. For example, different locking mechanisms of the locking member 30 can be incorporated with the integrated structure of the locking member and the securing member 20. The heat resistant cushioning layer 40, the locker ring 40' and the flashlight module 40" are examples to show the incorporation of the top utility surface 211 of the mounting body 21. Other firearm accessories can be provided on the top utility surface 211 of the mounting body 21. Preferably, the locking member 30 is extended from the securing member 20 to form an elongated structure. It should be appreciated that the locking member 30 can be sidewardly extended from the securing member 20. Furthermore, the mounting body 31C with the longitudinal mounting portions 212C can incorporate different locking configurations of the locking member 30.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A keymod mount for detachably coupling at a firearm having one or more keymod slots, comprising:

a securing member which comprises a mounting body having a top utility surface, and a coupling head downwardly extended from a bottom surface of said mounting body for slidably engaging with a narrow slot portion of said keymod slot from an enlarged slot portion thereof to retain said mounting body on a top surface of said keymod slot; and a locking member movably extended from said securing member, wherein said locking member comprises a locking body and a locking head downwardly extended from a bottom surface of said locking body for coupling at said enlarged slot portion of said keymod slot after said coupling head is engaged with said narrow slot portion thereof, so as to securely lock up said securing member on said firearm, wherein said locking member is pivotally coupled with said securing member via a pivot joint, such that when said locking body is pivotally folded on said top side of said keymod slot, said locking head is arranged for inserting into said enlarged slot portion of said keymod slot after said coupling head is slid to engage with said narrow slot portion of said keymod slot.

2. A keymod mount for detachably coupling at a firearm having one or more keymod slots, comprising:

a securing member which comprises a mounting body having a top utility surface, and a coupling head downwardly extended from a bottom surface of said mounting body for slidably engaging with a narrow slot portion of said keymod slot from an enlarged slot portion thereof to retain said mounting body on a top surface of said keymod slot; and a locking member movably extended from said securing member, wherein said locking member comprises a locking body and a locking head downwardly extended from a bottom surface of said locking body for coupling at said enlarged slot portion of said keymod slot after said coupling head is engaged with said narrow slot portion thereof, so as to securely lock up said securing member on said firearm, wherein a distance between said coupling head and said locking head matches with a distance between said narrow slot portion and said enlarged slot portion, wherein said locking member is pivotally coupled with said securing member via a pivot joint, such that when said locking body is pivotally folded on said top side of said keymod slot, said locking head is arranged for inserting into said enlarged slot portion of said keymod slot after said coupling head is slid to engage with said narrow slot portion of said keymod slot.

3. The keymod mount; as recited in claim 1, wherein said coupling head has an enlarged head portion and an elongated neck portion integrally extended from said bottom surface of said mounting body to said enlarged head portion, such that said enlarged head portion of said coupling head is arranged for sliding under said narrow slot portion of said keymod slot to secure said mounting body on said top said of said keymod slot.

4. A keymod mount for detachably coupling at a firearm having one or more keymod slots, comprising:

a securing member which comprises a mounting body having a top utility surface, and a coupling head downwardly extended from a bottom surface of said mounting body for slidably engaging with a narrow slot portion of said keymod slot from an enlarged slot portion thereof to retain said mounting body on a top surface of said keymod slot; and a locking member movably extended from said securing member, wherein said locking member comprises a locking body and a locking head downwardly extended from a bottom surface of said locking body for coupling at said enlarged slot portion of said keymod slot after said coupling head is engaged with said narrow slot portion thereof, so as to securely lock up said securing member on said firearm, wherein said locking head has a curved engaging surface matching with a curvature of said enlarged slot portion of said keymod slot, and a slanted guiding surface extended to said curved engaging surface to guide said curved engaging surface to engage with said enlarged slot portion of said keymod slot.

5. The keymod mount, as recited in claim 3, wherein said locking head has a curved engaging surface matching with a curvature of said enlarged slot portion of said keymod slot, and a slanted guiding surface extended to said curved engaging surface to guide said curved engaging surface to engage with said enlarged slot portion of said keymod slot.

6. A keymod mount for detachably coupling at a firearm having one or more keymod slots, comprising:

a securing member which comprises a mounting body having a top utility surface, and a coupling head downwardly extended from a bottom surface of said mounting body for slidably engaging with a narrow slot portion of said keymod slot from an enlarged slot portion thereof to retain said mounting body on a top surface of said keymod slot; and a locking member movably extended from said securing member, wherein said locking member comprises a locking body and a locking head downwardly extended from a bottom surface of said locking body for coupling at said enlarged slot portion of said keymod slot after said coupling head is engaged with said narrow slot portion thereof, so as to securely lock up said securing member on said firearm, wherein said locking body further has an indented edge portion formed underneath a top surface of said locking body and above said top side of said keymod slot for enabling said locking body to move away from said top side of said keymod slot so as to detach said locking head from said enlarged slot portion of said keymod slot.

7. The keymod mount, as recited in claim 3, wherein said locking body further has an indented edge portion formed underneath a top surface of said locking body and above said top side of said keymod slot for enabling said locking body to move away from said top side of said keymod slot so as to detach said locking head from said enlarged slot portion of said keymod slot.

8. The keymod mount, as recited in claim 5, wherein said locking body further has an indented edge portion formed underneath a top surface of said locking body and above said top side of said keymod slot for enabling said locking body to move away from said top side of said keymod slot so as to detach said locking head from said enlarged slot portion of said keymod slot.

9. The keymod mount, as recited in claim 5, wherein said locking head is made of elastic material for engaging with said enlarged slot portion of said keymod slot by means of elastic force.

10. A keymod mount for detachably coupling at a firearm having one or more keymod slots, comprising:

a securing member which comprises a mounting body having a top utility surface, and a coupling head downwardly extended from a bottom surface of said mounting body for slidably engaging with a narrow slot portion of said keymod slot from an enlarged slot portion thereof to retain said mounting body on a top surface of said keymod slot; and a locking member movably extended from said securing member, wherein said locking member comprises a locking body and a locking head downwardly extended from a bottom surface of said locking body for coupling at said enlarged slot portion of said keymod slot after said coupling head is engaged with said narrow slot portion thereof, so as to securely lock up said securing member on said firearm, wherein said locking head is rotatably extended from said bottom side of said locking body, wherein said locking head has an elongated locking wing portion arranged in such a manner that when said locking head is rotated, said locking wing portion is moved for engaging with said enlarged slot portion of said keymod slot so as to lock up said locking head at said enlarged slot portion of said keymod slot.

11. A keymod mount for detachably coupling at a firearm having one or more keymod slots, comprising:

a securing member which comprises a mounting body having a top utility surface, and a coupling head downwardly extended from a bottom surface of said mounting body for slidably engaging with a narrow slot portion of said keymod slot from an enlarged slot portion thereof to retain said mounting body on a top surface of said keymod slot; and a locking member movably extended from said securing member, wherein said locking member comprises a locking body and a locking head downwardly extended from a bottom surface of said locking body for coupling at said enlarged slot portion of said keymod slot after said coupling head is engaged with said narrow slot portion thereof, so as to securely lock up said securing member on said firearm, wherein said coupling head has an enlarged head portion and an elongated neck portion integrally extended from said bottom surface of said mounting body to said enlarged head portion, such that said enlarged head portion of said coupling head is arranged for sliding under said narrow slot portion of said keymod slot to secure said mounting body on said top said of side keymod slot, wherein said locking head is rotatably extended from said bottom side of said locking body, wherein said locking head has an elongated locking wing portion arranged in such a manner that when said locking head is rotated, said locking wing portion is moved for engaging with said enlarged slot portion of said keymod slot so as to lock up said locking head at said enlarged slot portion of said keymod slot.

12. The keymod mount, as recited in claim 5, wherein said locking head is rotatably extended from said bottom side of said locking body, wherein said locking head has an elongated locking wing portion arranged in such a manner that when said locking head is rotated, said locking wing portion is moved for engaging with said enlarged slot portion of said keymod slot so as to lock up said locking head at said enlarged slot portion of said keymod slot.

13. The keymod mount, as recited in claim 5, wherein said locking head is integrally extended from said bottom side of said locking body, wherein said locking head is made of flexible material for generating a spring force to bias against and engage with said enlarged slot portion of said keymod slot so as to lock up said locking head at said enlarged slot portion of said keymod slot.

14. The keymod mount, as recited in claim 5, wherein a length of said mounting body is larger than a length of said keymod slot, such that said coupling head and said locking head are arranged for engaging with said narrow slot portion of a first keymod slot and with said enlarged slot portion of an adjacent second keymod slot respectively.

15. The keymod mount, as recited in claim 5, wherein said mounting body has a plurality of longitudinal mounting portions integrally extended side-by-side in an angled manner to define said top utility surface on each of said longitudinal mounting portions, wherein said coupling head is extended from said bottom surface of at least one of said longitudinal mounting portions, wherein said locking member is movably extended from at least one of said longitudinal mounting portions.

16. A keymod mount for detachably coupling at a firearm having one or more keymod slots, comprising:

a securing member which comprises a mounting body having a top utility surface, and a coupling head downwardly extended from a bottom surface of said mounting body for slidably engaging with a narrow slot portion of said keymod slot from an enlarged slot portion thereof to retain said mounting body on a top surface of said keymod slot;

a locking member movably extended from said securing member, wherein said locking member comprises a locking body and a locking head downwardly extended from a bottom surface of said locking body for coupling at said enlarged slot portion of said keymod slot after said coupling head is engaged with said narrow slot portion thereof, so as to securely lock up said securing member on said firearm, wherein a distance between said coupling head and said locking head matches with a distance between said narrow slot portion and said enlarged slot portion, and a heat resistant cushioning layer provided on said top utility surface of said securing member to form a handguard cover.

17. A keymod mount for detachably coupling at a firearm having one or more keymod slots, comprising:

a securing member which comprises a mounting body having a top utility surface, and a coupling head downwardly extended from a bottom surface of said mounting body for slidably engaging with a narrow slot portion of said keymod slot from an enlarged slot portion thereof to retain said mounting body on a top surface of said keymod slot;

a locking member movably extended from said securing member, wherein said locking member comprises a locking body and a locking head downwardly extended from a bottom surface of said locking body for coupling at said enlarged slot portion of said keymod slot after said coupling head is engaged with said narrow slot portion thereof, so as to securely lock up said securing member on said firearm, wherein a distance between said coupling head and said locking head matches with a distance between said narrow slot portion and said enlarged slot portion, wherein said coupling head has an enlarged head portion and an elongated neck portion integrally extended from said bottom surface of said mounting body to said enlarged head portion, such that said enlarged head portion of said coupling head is arranged for sliding under said narrow slot portion of said keymod slot to secure said mounting body on said top said of side keymod slot; and a heat resistant cushioning layer provided on said top utility surface of said securing member to form a handguard cover.

18. The keymod mount, as recited in claim 5, further comprising a heat resistant cushioning layer provided on said top utility surface of said securing member to form a handguard cover.

19. The keymod mount, as recited in claim 5, further comprising a firearm accessory attached on said top utility surface of said securing member for detachably mounting on said firearm.

* * * * *